US008397682B2

(12) United States Patent
Hamada

(10) Patent No.: US 8,397,682 B2
(45) Date of Patent: Mar. 19, 2013

(54) MULTIPLE CYLINDER ENGINE COOLING APPARATUS

(75) Inventor: Tsunero Hamada, Iwata (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 847 days.

(21) Appl. No.: 12/523,830

(22) PCT Filed: Feb. 7, 2008

(86) PCT No.: PCT/JP2008/052043

§ 371 (c)(1),
(2), (4) Date: Jul. 20, 2009

(87) PCT Pub. No.: WO2008/096819

PCT Pub. Date: Aug. 14, 2008

(65) Prior Publication Data

US 2010/0089343 A1 Apr. 15, 2010

(30) Foreign Application Priority Data

Feb. 7, 2007 (JP) ..... 2007-028069

(51) Int. Cl.
*F02F 1/36* (2006.01)

(52) U.S. Cl. ..... 123/41.82 R

(58) Field of Classification Search ..... 123/41.31, 123/41.72, 41.82 R, 41.82 A, 193.5
See application file for complete search history.

(56) References Cited

U.S. PATENT DOCUMENTS

| | | | | |
|---|---|---|---|---|
| 3,353,522 | A * | 11/1967 | Ley | 123/41.31 |
| 4,700,665 | A * | 10/1987 | Kanda et al. | 123/41.82 R |
| 5,799,627 | A * | 9/1998 | Dohn et al. | 123/41.82 R |
| 5,983,843 | A * | 11/1999 | Suzuki et al. | 123/41.82 R |
| 6,279,516 | B1 * | 8/2001 | Haugen et al. | 123/41.82 R |
| 6,427,642 | B1 * | 8/2002 | Beer et al. | 123/41.82 R |
| 6,499,444 | B1 * | 12/2002 | Batzill et al. | 123/41.82 R |
| 6,681,727 | B2 * | 1/2004 | Krenn | 123/41.82 R |
| 6,799,540 | B2 * | 10/2004 | Akiwa et al. | 123/41.82 R |
| 2002/0170510 | A1 * | 11/2002 | Iizuka et al. | 123/41.84 |
| 2005/0145205 | A1 | 7/2005 | Haubner | |
| 2006/0196453 | A1 * | 9/2006 | Yamada et al. | 123/41.32 |

FOREIGN PATENT DOCUMENTS

| | | |
|---|---|---|
| JP | 64 34423 | 3/1989 |
| JP | 2000-73856 A | 3/2000 |
| JP | 2003 184643 | 7/2003 |
| JP | 2003 184644 | 7/2003 |
| JP | 2005 535819 | 11/2005 |
| JP | 2006 242030 | 9/2006 |

* cited by examiner

*Primary Examiner* — Noah Kamen
*Assistant Examiner* — Hung Q Nguyen
(74) *Attorney, Agent, or Firm* — Oblon, Spivak, McClelland, Maier & Neustadt, L.L.P.

(57) ABSTRACT

A multiple cylinder engine cooling apparatus includes a bottom wall of a cylinder head, a lower end of a spark plug inserting cylindrical wall, a lower end of an inlet port, an exhaust port, and a water jacket. A plurality of combustion chamber forming recesses are formed in the cylinder head to line up in a longitudinal direction parallel to an axial direction of a crank shaft. The spark plug inserting cylindrical wall extends from each recess upward in a direction opposite to a combustion chamber. The inlet port extends from each recess laterally in one direction perpendicular to the longitudinal direction. The exhaust port extends from each recess laterally in the other direction. The water jacket is formed in the cylinder head to cool the bottom wall of the cylinder head, the lower end of the spark plug inserting cylindrical wall, the lower end of the inlet port, and the exhaust port. The water jacket includes a first water jacket portion and a second water jacket portion. Cooling water flows in the first water jacket portion in the lateral direction for each cylinder. The second water jacket portion is connected to the first water jacket portion through a narrow channel and guides the cooling water from an interior of the first water jacket portion upward along the exhaust port.

8 Claims, 9 Drawing Sheets

MULTIPLE CYLINDER ENGINE COOLING APPARATUS

TECHNICAL FIELD

The present invention relates to a multiple cylinder engine cooling apparatus in which cooling water flows around a spark plug in the lateral direction perpendicular to the axial direction of a crank shaft.

Conventionally, a water-cooling multiple cylinder engine mainly employs the following two cooling structures to cool the interior of a cylinder head. According to the first cooling structure, cooling water flows in the cylinder head in the axial direction (this direction will merely be referred to as the longitudinal direction hereinafter) of the crank shaft. According to the second cooling structure, the cooling water flows in the lateral direction perpendicular to the longitudinal direction.

With the first cooling structure, as the cooling water flows in the direction along which cylinders line up, the cooling efficiency changes between a cylinder located upstream and a cylinder located downstream of a cooling water channel. Hence, in the first cooling structure, to cool all cylinders evenly, the flow rate of the cooling water must be higher than that in the second cooling structure.

As a multiple cylinder engine cooling apparatus employing the second cooling structure, for example, one described in Japanese Patent Laid-Open No. 2000-73856 is available. The engine disclosed in this reference is a V-type multiple cylinder engine. According to the cooling apparatus of this engine, cooling water flows inside the water jacket of a cylinder head from an inlet port side to an exhaust port side.

This water jacket is formed to cool a cylinder head bottom wall where a plurality of combustion chamber forming recesses which line up in the longitudinal direction are formed, the lower ends of spark plug inserting cylindrical walls extending upward from the respective recesses in the direction opposite to the combustion chambers, the lower ends of inlet ports extending from the respective recesses laterally in one direction, exhaust ports extending from the respective recesses laterally in the other direction, valve stem guides for exhaust valves extending upward from the intermediate portions of the exhaust ports, and the like.

The cooling water inlets of the water jacket are formed of a cooling water supply pipe inserted in the space between the inlet ports and a cylinder block. This pipe extends in the longitudinal direction and is attached to the cylinder head. The cooling water inlets comprise through holes formed in the pipe at positions corresponding to the cylinders.

The cooling water outlets of the water jacket are open at positions in the bottom wall which correspond to the peripheries of cylinder bores and connected to cooling water return channels in the cylinder body.

DISCLOSURE OF INVENTION

Problem to be Solved by the Invention

In the cooling apparatus disclosed in the above reference, although all cylinders can be cooled evenly, the highest-temperature portion cannot always be cooled efficiently. The highest-temperature portion includes those portions of the cylinder head bottom wall which form the combustion chamber forming recesses, the lower ends of the spark plug inserting cylindrical walls, the lower ends of the exhaust ports, and the like.

These high-temperature portions cannot be cooled efficiently because the water jacket is formed such that the cooling water flows not only through the high-temperature portions but also through portions (portions the temperatures of which are not very high) above the high-temperature portions. Examples of the portions located above the high-temperature portions include portions above the exhaust ports, peripheries of the valve stem guides for the exhaust valves, and the like.

As the water jacket is formed to cover the portions above the high-temperature portions as well in this manner, the volumes of those portions of the water jacket which corresponds to the high-temperature portions undesirably increase more than necessary.

Namely, in the cooling apparatus shown in the above reference, as the volumes of the portions that cool the high-temperature portions are large, the velocities of the cooling water flowing through these portions decrease, so the high-temperature portions cannot be cooled efficiently.

It is an object of the present invention to provide a multiple cylinder engine cooling apparatus which can efficiently cool the highest-temperature portion in the cylinder head while adopting an arrangement in which cooling water flows laterally in the cylinder head.

Means of Solution to the Problem

In order to achieve the above object, according to the present invention, there is provided a multiple cylinder engine cooling apparatus comprising a bottom wall of a cylinder head in which a plurality of combustion chamber forming recesses are formed to line up in a longitudinal direction parallel to an axial direction of a crank shaft, a lower end of a spark plug inserting cylindrical wall extending from each of the recesses upward in a direction opposite to a combustion chamber, a lower end of an inlet port extending from each of the recesses laterally in one direction perpendicular to the longitudinal direction, an exhaust port extending from each of the recesses laterally in the other direction, and a water jacket formed in the cylinder head to cool the bottom wall of the cylinder head, the lower end of the spark plug inserting cylindrical wall, the lower end of the inlet port, and the exhaust port, the water jacket comprising a first water jacket portion through which cooling water flows in the lateral direction for each cylinder, and a second water jacket portion which is connected to the first water jacket portion through a narrow channel and guides the cooling water from an interior of the first water jacket portion upward along the exhaust port.

EFFECTS OF THE INVENTION

According to the present invention, the narrow channels can suppress the flow rate of cooing water flowing from the first water jacket portions into the second water jacket portions. Hence, the cooing water flowing in the first water jacket portions becomes the main cooling water, so that a sufficient water amount in the first water jacket portions can be ensured. In addition, since the volumes of the first water jacket portions can be substantially decreased, a sufficient velocity of the cooling water can be obtained in the first water jacket portions.

Hence, the present invention can provide a multiple cylinder engine cooling apparatus which employs an arrangement in which the cooling water flows in the cylinder head in the lateral direction, so that the highest-temperature portion in the cylinder head can be efficiently cooled while cooling the interior of the cylinder head to eliminate a temperature difference among the cylinders.

The cooling water is supplied from the first water jacket portions to the second water jacket portions, which cools the portions above the exhaust ports, through the narrow channels. This allows the cylinder head to have a simpler structure than in a case in which the cooling water is supplied to the second water jacket portions from outside the cylinder head through a dedicated cooling water channel. As a result, the present invention can make the cylinder head compact.

Figure 1:
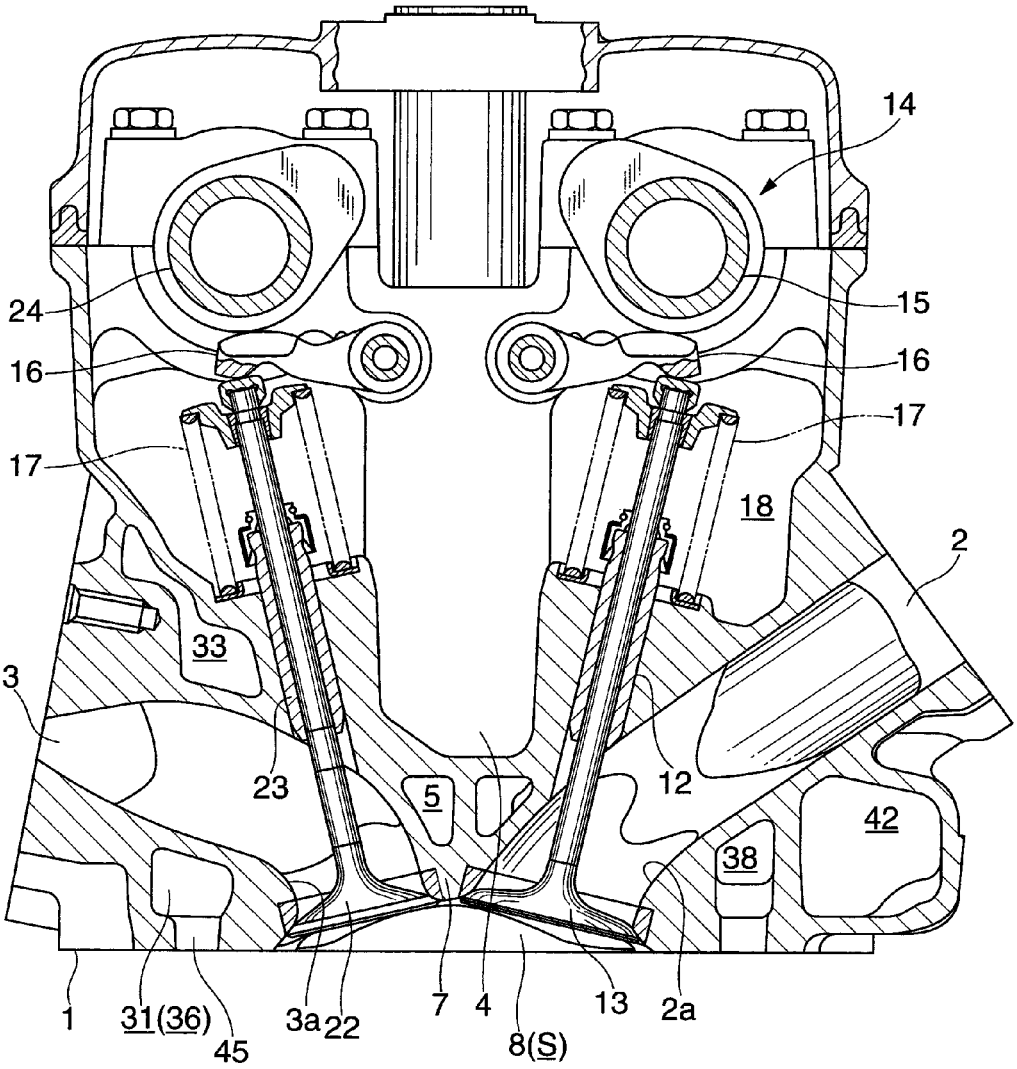
FIG. 1 is a sectional view of a cylinder head provided with a cooling apparatus according to the present invention.

BEST MODE FOR CARRYING OUT THE INVENTION (First Embodiment)

A multiple cylinder engine cooling apparatus according to an embodiment of the present invention will be described in detail with reference to FIGS. 1 to 8.

Referring to FIGS. 1 to 8, reference numeral 1 denotes a cylinder head for a multiple cylinder engine according to this embodiment.

The cylinder head 1 is mounted on a water-cooling V-type 8-cylinder engine (not shown) for an automobile and molded into a predetermined shape by so-called low-pressure casting. The cylinder head 1 is provided to each of two cylinder rows of the V-type engine. Such cylinder heads 1 are attached to a cylinder block such that the inlet system of one cylinder head opposes the other cylinder head. In other words, in FIG. 1, the cylinder head 1 is attached to the cylinder block such that its right end is close to the center of the engine. By mounting the cylinder head 1 on the cylinder block in this manner, the exhaust system side portion of the cylinder head 1 is located under its inlet side. In this embodiment, a cylinder head which is mounted on one cylinder row of the two cylinder rows will be described.

Figure 2:
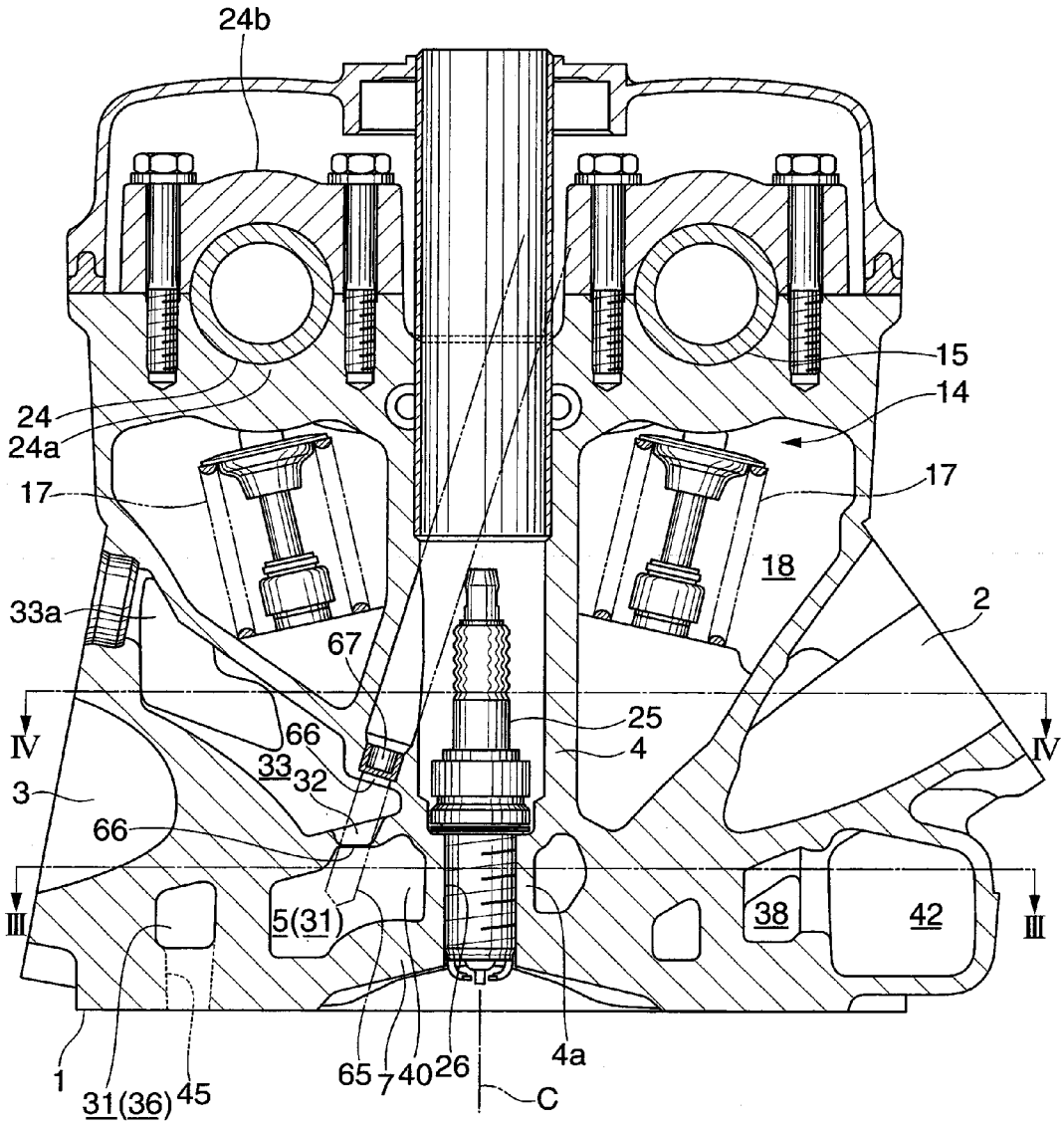
FIG. 2 is a sectional view of the cylinder head provided with the cooling apparatus according to the present invention.

As shown in FIGS. 1 and 2, inlet ports 2 and exhaust ports 3 (both will be described later), spark plug inserting cylindrical walls 4, and a water jacket 5 are formed in the cylinder head 1. The cylinder head 1 is mounted on the cylinder block (not shown) through a head gasket, and attached to the cylinder block with head bolts (not shown). Bolt holes in which the bolts are to be inserted are denoted by reference numerals 6 in FIGS. 3 and 4. Oil return holes 9 are formed in the vicinities of the bolt holes 6.

As shown in FIG. 1, each inlet port 2 extends from a combustion chamber forming recess 8 formed in a bottom wall 7 of the cylinder head 1 (to be merely referred to as a cylinder head bottom wall 7 hereinafter) to one side (rightward in FIG. 1) in the lateral direction perpendicular to the axial direction of a crank shaft (not shown). The inlet port 2 according to this embodiment has a Y shape with a pair of branch ports 2*a* (see FIGS. 1, 3, and 6) at its downstream end to form a so-called siamese port.

Figure 6:
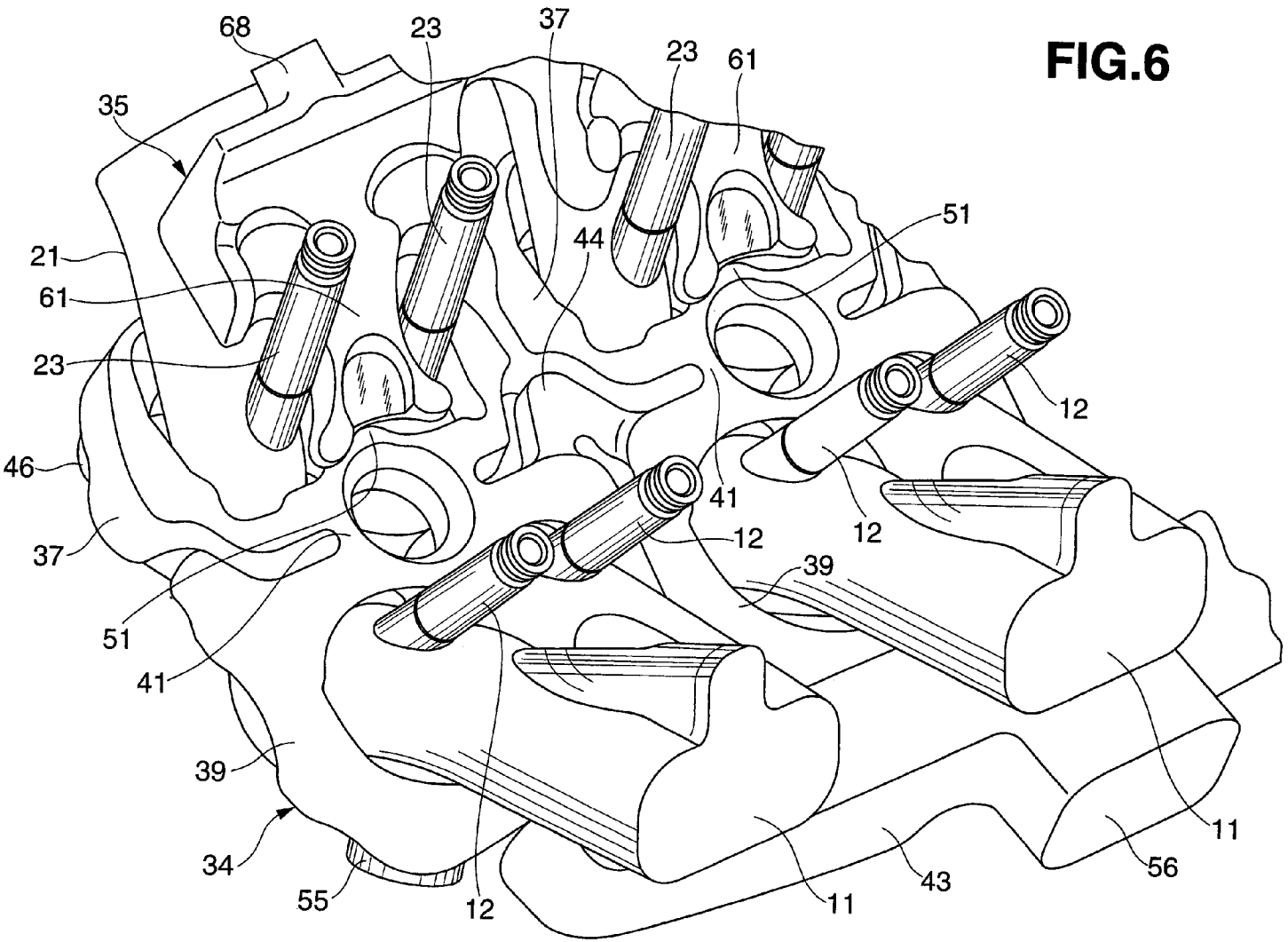
FIG. 6 is an enlarged perspective view of the main part of the first core and second core.

As shown in FIG. 6, the inlet port 2 is molded into a predetermined shape using an inlet port core 11. The inlet port core 11 shown in FIG. 6 is virtually illustrated together with valve stem guides 12 for inlet valves.

Inlet valves 13 respectively open/close the two branch ports 2*a*. The inlet valves 13 are supported in the cylinder head 1 by the valve stem guides 12 as shown in FIG. 1 and driven by a driving device 14 provided in the upper portion of the cylinder head 1.

The driving device 14 transmits a driving force from an inlet cam shaft 15 to the inlet valve 13 through a rocker arm 16 to drive the inlet valve 13 against the spring force of a valve spring 17. The driven members of the driving device 14 such as the rocker arm 16 and valve spring 17 are accommodated in a valve chamber 18 (see FIGS. 1 and 2) formed in the cylinder head 1. The valve chamber 18 is molded into a predetermined shape by using a core (not shown) different from that for the water jacket 5 (to be described later).

An injector (not shown) which injects fuel into the pair of branch ports 2*a* is attached to the vicinity of the upstream end of the inlet port 2 in the cylinder head 1.

The exhaust port 3 is formed to extend from the combustion chamber forming recess 8 to the other side (leftward in FIG. 1) in the lateral direction. The exhaust port 3 according to this embodiment has a Y shape with a pair of branch ports 3*a* (see FIGS. 1 and 3) at its upstream end to form a so-called siamese port. The exhaust port 3 is also molded into a predetermined shape using an exhaust port core 21 (see FIG. 6). Exhaust valves 22 respectively open/close the two branch ports 3*a*. The exhaust valves 22 are supported to the cylinder head 1 by valve stem guides 23 as shown in FIG. 1 and driven by an exhaust cam shaft 24 of the driving device 14. As shown in FIG. 2, a journal 24*a* and cam cap 24*b* formed at the upper end of the cylinder head 1 rotatably support the exhaust cam shaft 24.

The cylinder head bottom wall 7 is formed by casting together with the inlet port 2, exhaust port 3, water jacket 5 (to be described later), and the like. As shown in FIGS. 1 and 2, the combustion chamber forming recesses 8 are formed at four locations in the cylinder head bottom wall 7 such that their lower surfaces project upward. The recesses 8 are arranged in the longitudinal direction (vertical direction in FIGS. 3 and 4) parallel to the axial direction of the crank shaft.

As shown in FIG. 2, a spark plug 25 is attached to that portion of the cylinder head bottom wall 7 which intersects an axis C of the cylinder when seen from the axial direction of the crank shaft. Although not shown, the spark plug 25 is arranged at almost the center of a combustion chamber S when seen from the axial direction of the cylinder.

The spark plug 25 is inserted in the corresponding cylindrical wall 4 formed in the water jacket 5 (to be described later) of the cylinder head 1. As show in FIG. 2, the spark plug 25 is screwed in a screw hole 26 formed to extend through the cylinder head bottom wall 7 and a lower end 4*a* of the cylindrical wall 4. The cylindrical wall 4 is formed to extend upward from the cylinder head bottom wall 7. The outer surface of the upper portion of the cylindrical wall 4 is molded by a valve chamber molding core (not shown). The inner surface of the cylindrical wall 4 is molded by a dedicated core (not shown).

Figure 3:
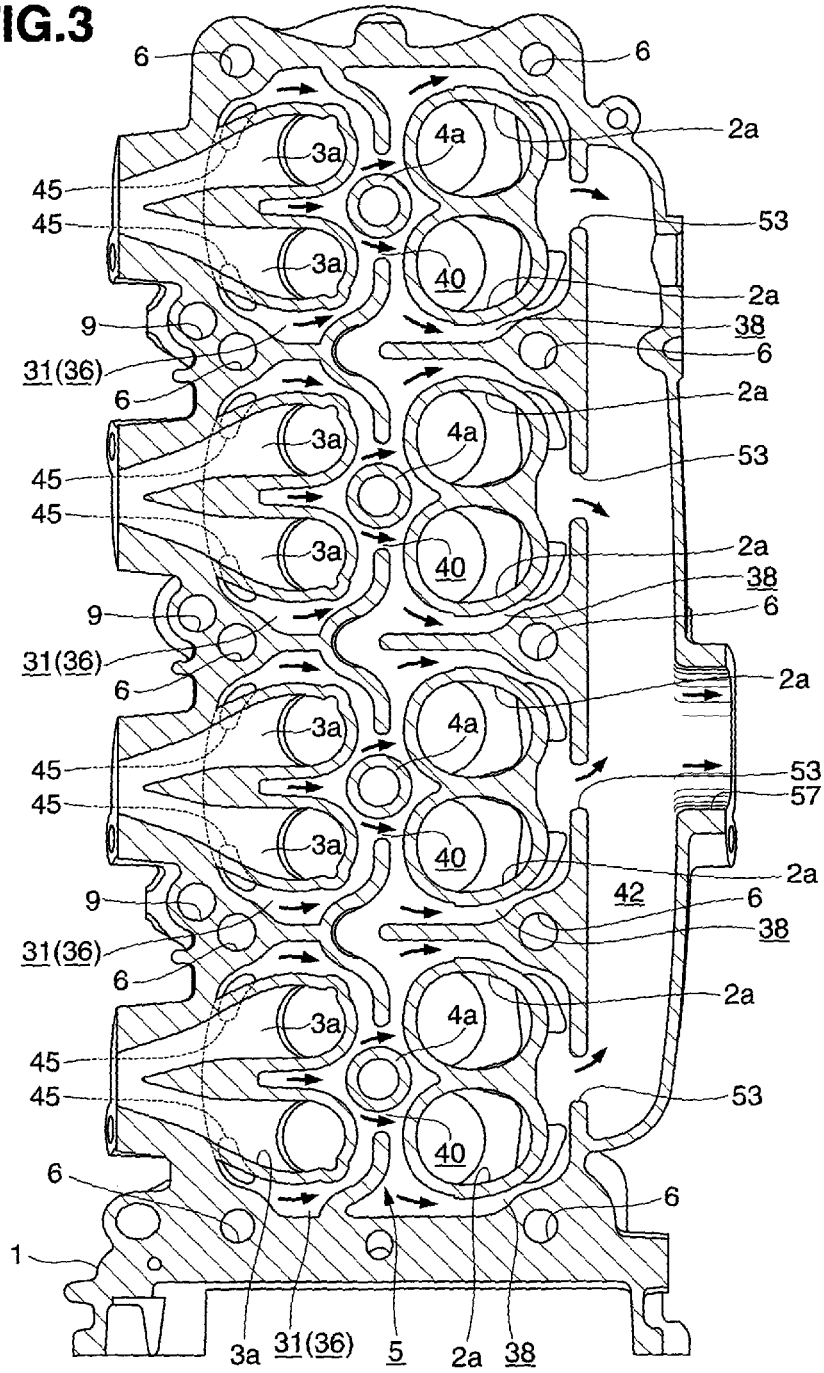
FIG. 3 is a sectional view taken along the line III-III of the cylinder head in FIG. 2.

The water jacket 5 is formed such that the cooling water cools the cylinder head bottom wall 7, the lower ends 4*a* of the spark plug inserting cylindrical walls 4, the lower ends of the inlet ports 2, the exhaust ports 3, and the valve stem guides 23 for the exhaust valves. In more detail, as shown in FIGS. 2 and 3, the water jacket 5 comprises first water jacket portions 31 through each of which the cooling water flows to one side in the lateral direction for the corresponding cylinder, and second water jacket portions 33 which are connected to the respective first water jacket portions 31 through narrow channels 32 (see FIG. 2) and guide the cooling water upward from the interiors of the first water jacket portions 31 along the exhaust ports 3.

The first water jacket portions 31 are molded by the first core denoted by reference numeral 34 in FIGS. 5 to 8. The second water jacket portions 33 are molded by the second core denoted by reference numeral 35 in FIGS. 5 to 7. The first core 34, second core 35, and the valve chamber interior forming cores and cylindrical wall molding cores (described above) are conventionally known shell cores and molded into predetermined shapes by dedicated molds.

The first core 34 is formed into a shape that covers the cylinder head bottom wall 7 from above and surrounds the lower ends 4*a* of the cylindrical walls 4 and the lower ends of the inlet ports 2 and exhaust ports 3. As shown in FIGS. 5 to 8, the first core 34 is integrally formed of upstream portions 37, downstream portions 39, central portions 41, and a longitudinal extending portion 43.

The upstream portions 37 of the first core 34 serve to mold upstream portions 36 (see FIG. 3) of the first water jacket portions 31 which surround the lower ends of the exhaust ports 3.

The downstream portions 39 serve to mold downstream portions 38 (see FIG. 3) of the first water jacket portions 31 which surround the exhaust ports 3.

The central portions 41 serve to mold central portions 40 (see FIG. 3) of the first water jacket portions 31 which surround the lower ends 4*a* of the cylindrical walls 4.

The longitudinal extending portion 43 serves to mold a first cooling water discharge channel 42 (see FIG. 3) where the cooling water is discharged from the first water jacket portions 31.

The central portions 41 of the first core 34 are interposed between the respective upstream portions 37 and downstream portions 39.

Figure 5:
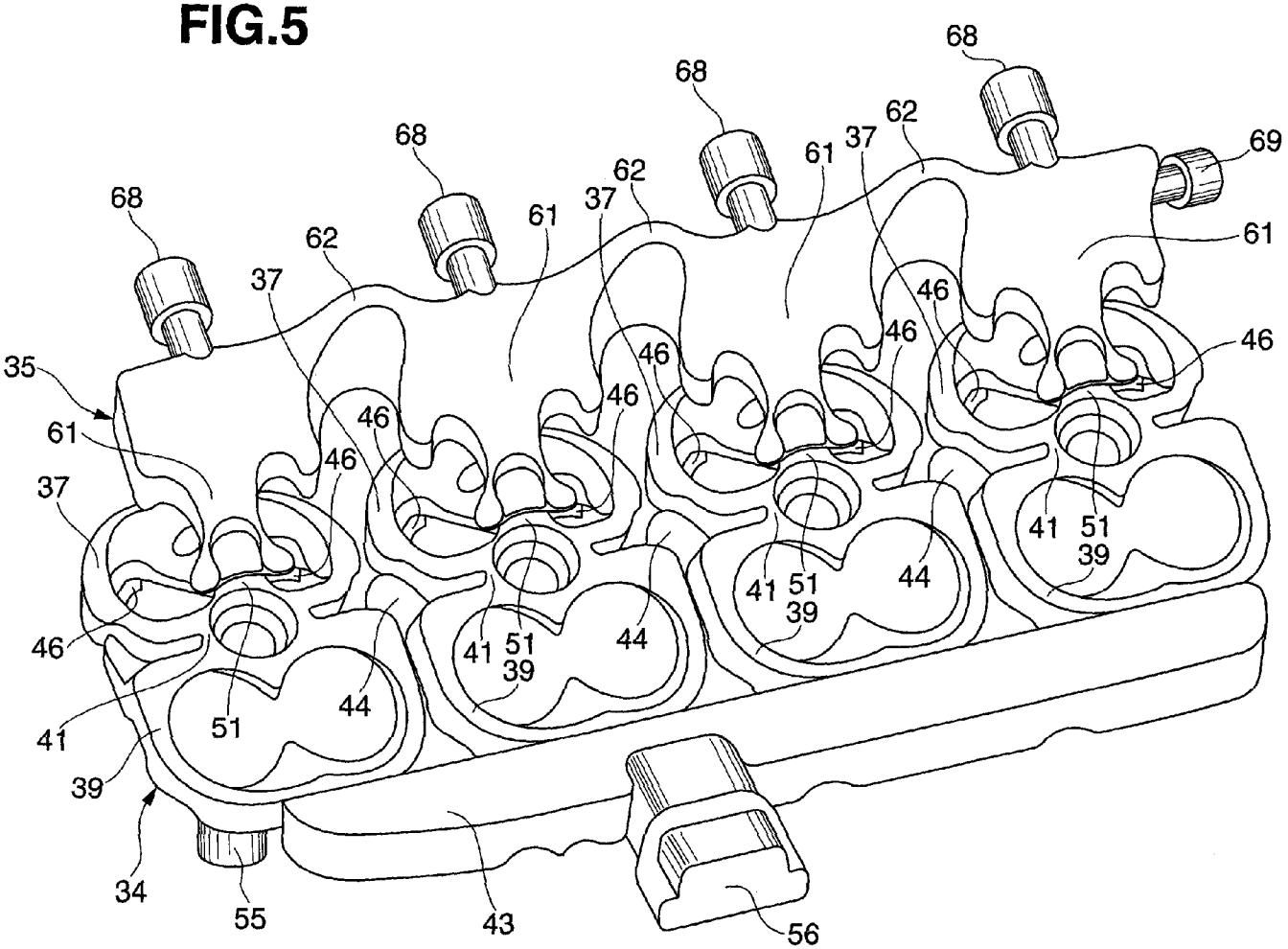
FIG. 5 is a perspective view showing a state in which the first core is combined with the second core.
Figure 8:
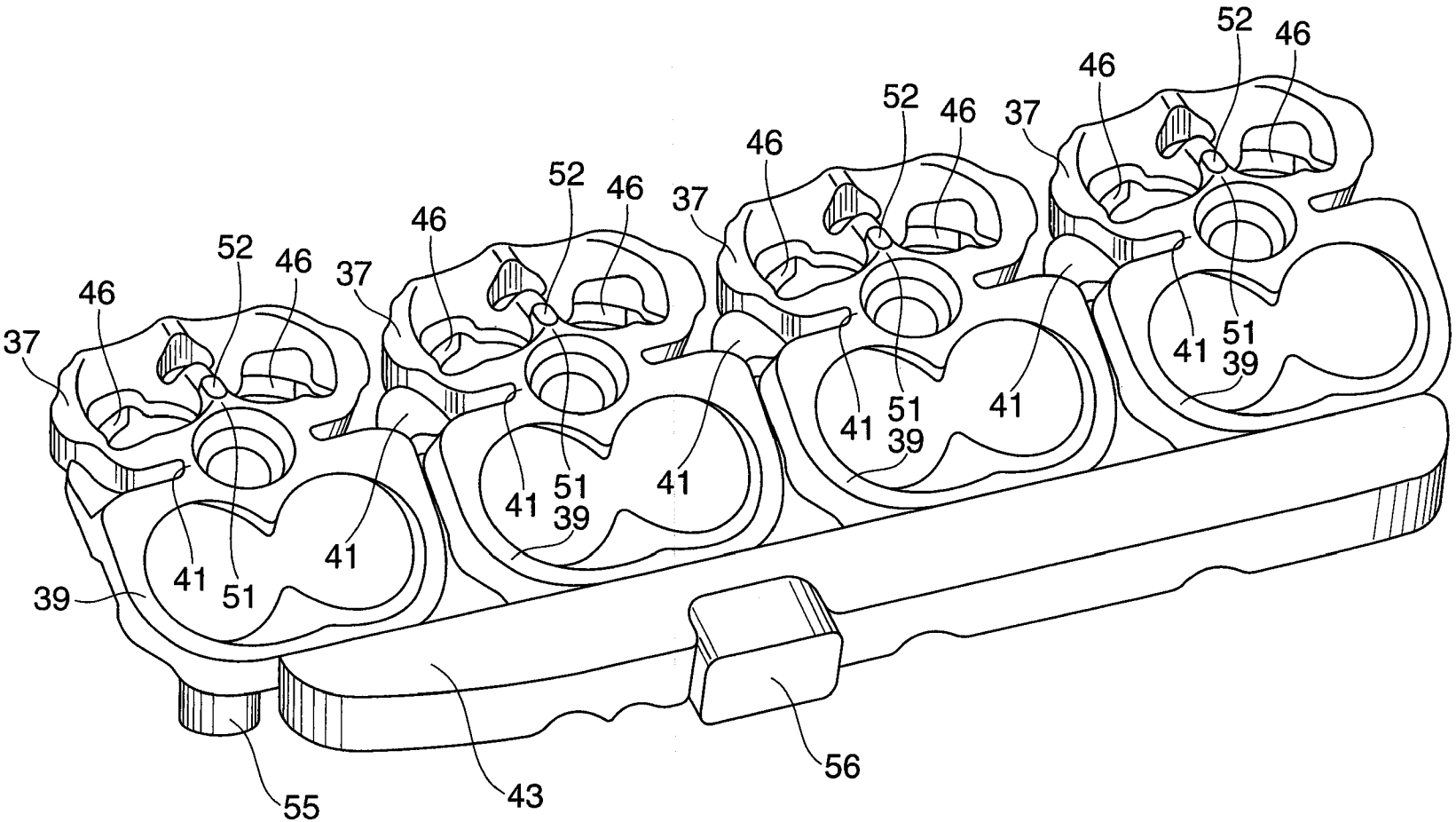
FIG. 8 is a perspective view showing the first core.

The upstream portions 37, downstream portions 39, and central portions 41 of the first core 34 are provided for the respective cylinders. As shown in FIGS. 5, 6, and 8, the downstream portions 39 of the cylinders are connected to each other through connecting portions 44 and coupled to each other through the longitudinal extending portion 43.

Figure 7:
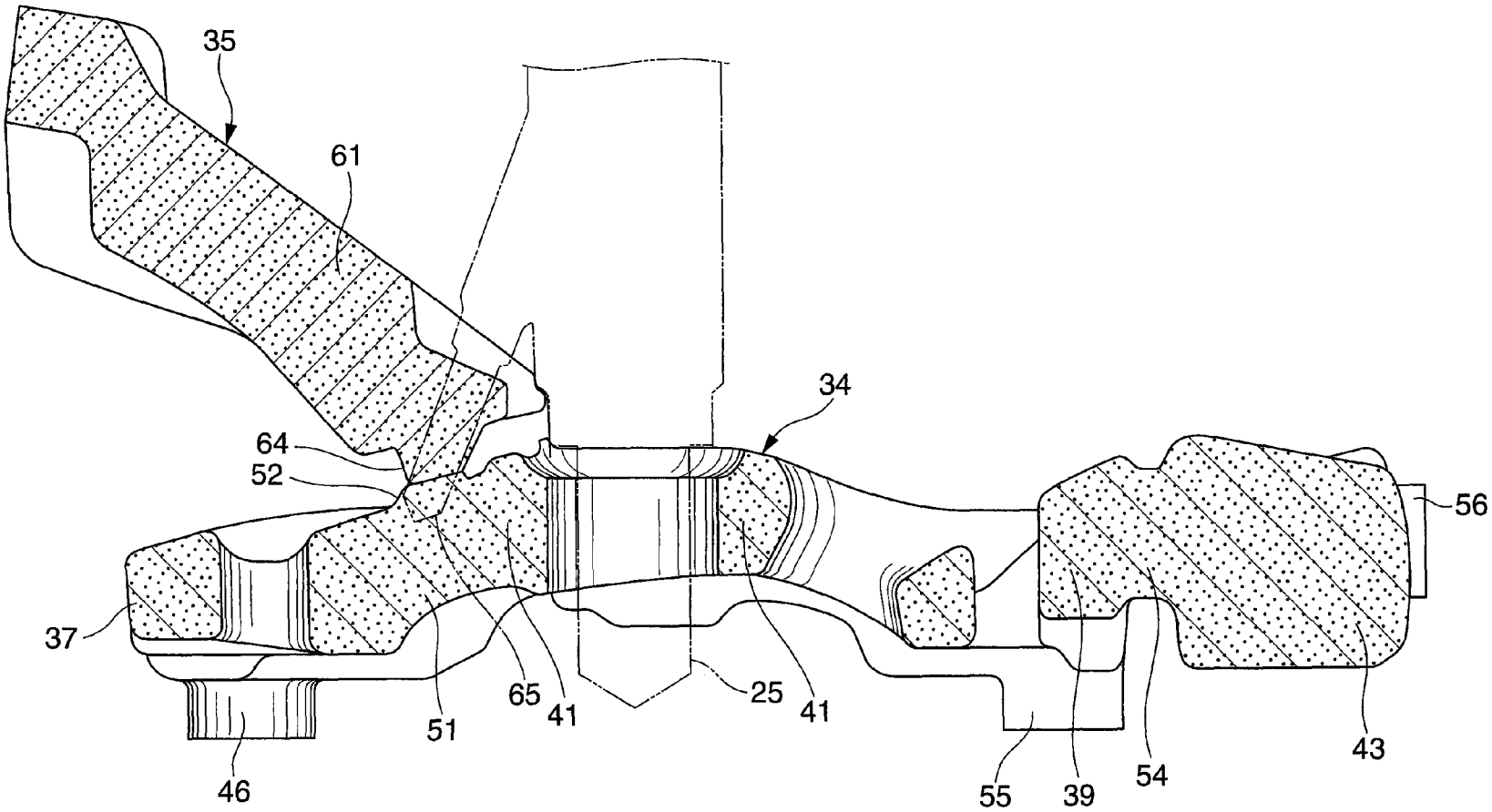
FIG. 7 is a sectional view showing a state in which the first core is combined with the second core.

As shown in FIGS. 5, 7, and 8, two columnar projections 46 project downward from each upstream portion 37 of the first core 34. The columnar projections 46 serve to mold cooling water inlets 45 (see FIGS. 1 and 2) of each cylinder of the water jacket 5. The columnar projections 46 also serve as core prints which support the first core 34.

As shown in FIGS. 7 and 8, the upstream portions 37 are respectively provided with bridging portions 51 on which the second core 35 (to be described above) is to be placed. Each bridging portion 51 is formed to extend across the two branch ports 3*a* of the corresponding exhaust port 3 laterally. More specifically, as shown in FIG. 3, each upstream portion 36 of the first water jacket portion 31 molded by the upstream portion 37 of the first core 34 is formed to surround the lower ends of the individual branch ports 3*a* throughout their entire regions. As shown in FIG. 7, a support seat 52 is formed at that portion of the bridging portion 51 where the second core 35 is to be placed such that this portion is higher than the remaining portions.

As shown in FIGS. 5 and 8, the downstream portions 39 of the first core 34 are formed to extend outside the inlet ports 2 of the respective cylinders. The downstream portions 39 are connected to the longitudinal extending portion 43 through necks 54 (see FIG. 7) which serve to mold cooling water outlets 53 (see FIG. 3) of the first water jacket portions 31 for the respective cylinders.

Two columnar projections 55 which form core prints for supporting the first core 34 are formed to project downward on the downstream portion 39 of each cylinder.

The central portions 41 of the first core 34 cooperate with the upstream portions 37 and downstream portions 39 to form annular portions that surround the lower ends 4*a* of the respective cylindrical walls 4.

The longitudinal extending portion 43 of the first core 34 forms an elongated rod shape extending from one end to the other end of the cylinder head 1 in the longitudinal direction. A columnar projection 56 is formed at the intermediate portion of the longitudinal extending portion 43 to project in a direction opposite to the downstream portions 39. The columnar projection 56 serves to mold a first cooling water discharge port 57 (see FIG. 3) through which the cooling water flowing in the first water jacket portions 31 is discharged outside the cylinder head 1.

As shown in FIG. 6, the second core 35 has a shape to cover the two branch ports 3*a* of each exhaust port 3 from above. In more detail, as shown in FIGS. 5 and 6, the second core 35 comprises lateral extending portions 61 for the respective cylinders and longitudinal extending portions 62 which connect the lateral extending portions 61. The lateral extending portions 61 serve to mold the second water jacket portions 33 (see FIG. 2) of the respective cylinders. The longitudinal extending portions 62 serve to mold communication channels 63 (see FIG. 4) which connect the second water jacket portions 33.

As shown in FIG. 6, each lateral extending portion 61 has a shape to extend between the two exhaust-valve valve stem guides 23 laterally along the corresponding exhaust port 3 so as to cover the exhaust port 3 from above.

As shown in FIG. 7, at one end (the end on the spark plug 25 side) of each lateral extending portion 61, a projection 64 serving to mold the narrow channel 32 (see FIG. 2) is formed to project downward.

The projection 64 is formed to have a smaller channel sectional area than that of any other portion of the second core 35 or each upstream portion 37 of the first core 34. The projection 64 is placed from above on (is in contact with) the support seat 52 of the bridging portion 51 formed in the first core 34. More specifically, one end of the second core 35 in the lateral direction is supported as it is placed on the first core 34.

Naturally, molten metal enters the portion between the contact surfaces of the projection 64 and support seat 52 during casting. When the first and second cores 34 and 35 are removed after casting, the molten metal entering between the contact surfaces remains in the narrow channel 32 in the form of a film-like burr which vertically divides the interior of the narrow channel 32 into two portions. After removing the first and second cores 34 and 35, the burr is removed by inserting a drill 65 into the narrow channel 32 and boring a through hole 66 in the cylinder head 1. This boring is performed by inserting the drill 65 from the inside of the spark plug inserting cylindrical wall 4 such that the drill 65 extends through the narrow channel 32 to reach the interior of the first water jacket portion 31. More specifically, the through hole 66 is formed at that portion of the narrow channel 32 which corresponds to the boundary of the first core 34 and second core 35. A plug member 67 closes the through hole 66 formed in the upper wall of the second water jacket portions 33 by the boring, so the cooling water will not leak from the through hole 66.

Figure 4:
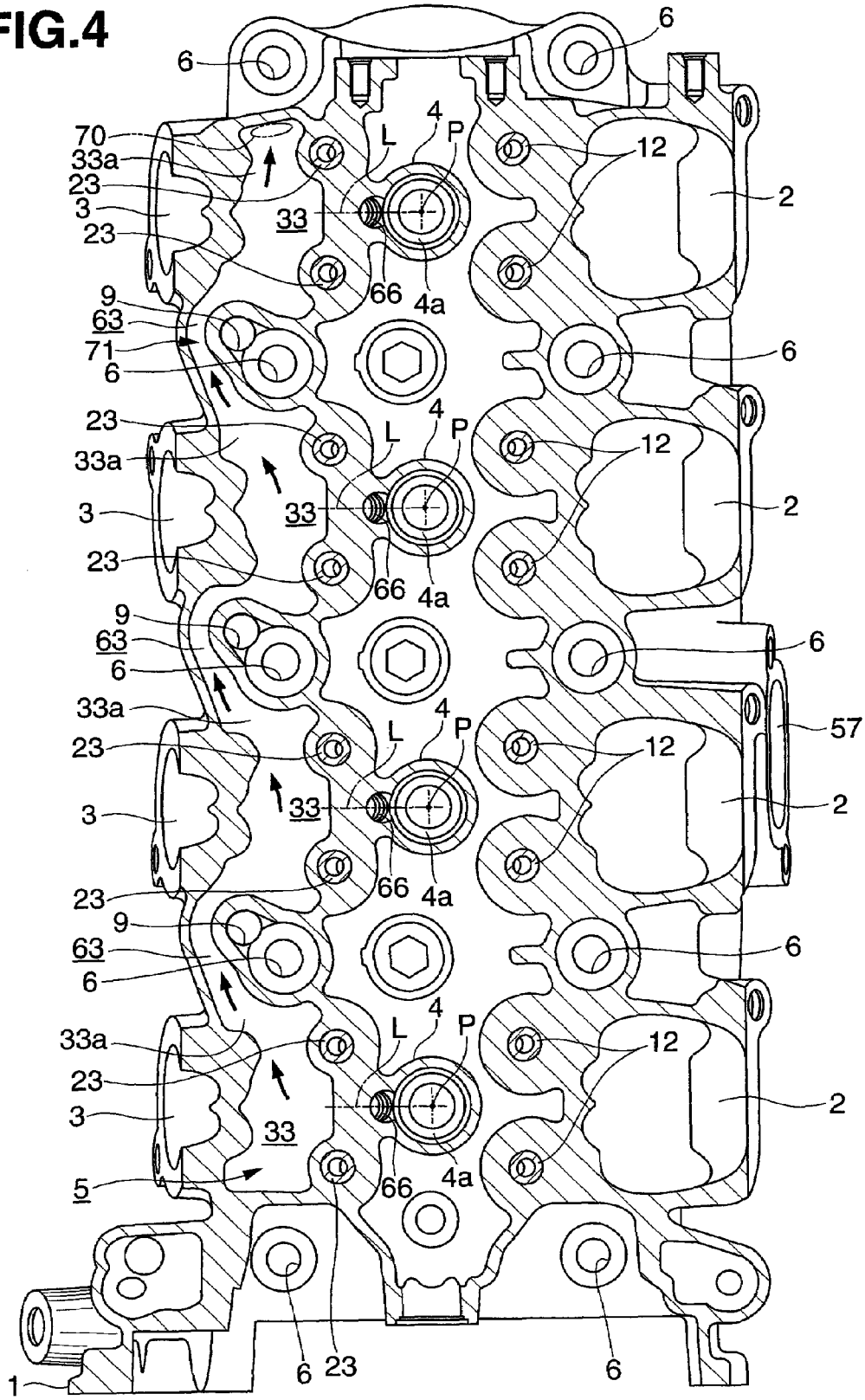
FIG. 4 is a sectional view taken along the line IV-IV of the cylinder head in FIG. 2.

As shown in FIG. 4, when seen from the axial direction of the cylinder, the narrow channel 32 and through hole 66 are located on a virtual line L which extends to the exhaust port side through a center P of the cylinder hole.

As shown in FIG. 5, a plurality of columnar projections 68 which form core prints project on the other end of the second core 35 in the lateral direction. The columnar projections 68 are formed on the end faces of the lateral extending portions 61 of the respective cylinders to project toward the side portion of the cylinder head 1. In other words, one end of the second core 35 in the lateral direction is supported by the first core 34, and its other end is supported by a mold (not shown) through the columnar projections 68.

Of the lateral extending portions 61 at four locations of the second core 35, the one located at the rightmost location in FIG. 5, that is, one end of the second core 35 in the longitudinal direction has a columnar projection 69 projecting outside the cylinder head 1. The columnar projection 69 serves to mold a second cooling water discharge port 70 of the second water jacket portions 33. The cooling water is discharged from the downstream ends of the second water jacket portions 33 outside the cylinder head 1 through the second cooling water discharge port 70.

As shown in FIG. 5, the longitudinal extending portions 62 of the second core 35 are curved. As shown in FIG. 4, the curves of the longitudinal extending portions 62 are aimed at forming the communication channels 63 outside the bolt holes 6 through which the head bolts (not shown) are to be inserted.

By forming the second water jacket portions 33 by molding using the second core 35 comprising the lateral extending portions 61 and longitudinal extending portions 62 for the respective cylinders, the downstream ends 33*a* of the second water jacket portions 33 of two adjacent cylinders communicate with each other through the corresponding communication channel 63, as shown in FIG. 4. As a result, the downstream ends 33*a* and the communication channels 63 form a second cooling water discharge channel 71. The cooling water in the second water jacket portions 33 flows in the longitudinal direction through the second cooling water discharge channel 71 and is discharged from the second cooling water discharge port 70.

The cooling water flows into the water jacket 5, formed by using the first core 34 and second core 35 described above, from the cooling water inlets 45 at the two locations of each cylinder. The cooling water inlets 45 are open under the corresponding first water jacket portion 31. First, in the upstream portion 36 of the first water jacket portion 31, the cooling water cools the lower end of the exhaust port 3, a portion around the exhaust port 3 in the cylinder head bottom wall 7, and a portion around the spark plug 25.

Part of the cooling water flows into the second water jacket portion 33 through the narrow channel 32. Most of the cooling water flows into the central portion 40 from the upstream portion 36 of the first water jacket portion 31. The narrow channel 32 is formed to have a smaller channel sectional area than that of the first water jacket portion 31 or second water jacket portion 33. Hence, the narrow channel 32 suppresses a decrease in flow rate of the cooling water in the first water jacket portion 31.

The cooling water flowing into the second water jacket portion 33 through the narrow channel 32 cools the portion above the exhaust port 3 and the exhaust-valve valve stem guide 23, and flows to the downstream end 33*a* of the second water jacket portion 33. The cooling water flows through the interior of, of the second water jacket portions 33 at the four locations, each of the three second water jacket portions 33 excluding the second water jacket portion 33 located most upstream in FIG. 4, to its downstream end 33*a*, and flows into the adjacent second water jacket portion 33 through the communication channel 63. The cooling water finally flows into the downstream end 33*a* of the second water jacket portion 33 which is at the uppermost position. This cooling water and the cooling water that has flowed in the interior of the uppermost second water jacket portion 33 and the narrow channel 32 to the downstream end 33*a* are discharged outside the cylinder head 1 from the second cooling water discharge port 70.

The cooling water that has flowed into the central portion 40 from the upstream portion 36 of the first water jacket portion 31 cools the lower end 4*a* of the spark plug inserting cylindrical wall 4 and that portion of the cylinder head bottom wall 7 which is around the cylindrical wall 4. This cooling water flows from the central portion 40 into the downstream portion 38 to cool, in the downstream portion 38, the lower end of the inlet port 2 and that portion of the cylinder head bottom wall 7 which is around the inlet port 2. After that, the cooling water is discharged to the first cooling water discharge channel 42 from the cooling water outlet 53. Separate streams of the cooling water that have flowed in the first water jacket portions 31 of the respective cylinders in the lateral direction and flowed into the first cooling water discharge channel 42 merge in the first cooling water discharge channel 42. The merged cooling water is discharged outside the cylinder head 1 from the intermediate portion of the first cooling water discharge channel 42 through the first cooling water discharge port 57.

According to the cooling apparatus having the water jacket 5 with this arrangement, the narrow channels 32 can suppress the flow rate of cooing water flowing from the first water jacket portions 31 into the second water jacket portions 33. Hence, in this cooling apparatus, the cooing water flowing in the first water jacket portions 31 becomes the main cooling water, so that a sufficient water amount in the first water jacket portions 31 can be ensured. In addition, since the volumes of the first water jacket portions 31 can be substantially decreased, a sufficient velocity of the cooling water can be obtained in the first water jacket portions 31.

Hence, according to this embodiment, by employing the arrangement in which the cooling water flows in the cylinder head 1 in the lateral direction, the highest-temperature portion in the cylinder head 1 can be efficiently cooled while cooling the interior of the cylinder head 1 to eliminate a temperature difference among the cylinders.

The first core 34 and second core 35 are in contact with each other at portions that mold the narrow channels 32. Hence, the portions that mold the narrow channels 32 are more free from breakage than in a case in which the two cores are formed integrally. In addition, the narrow channels 32 can be molded easily despite their small channel sectional areas. This allows formation of the narrow channels 32 to have smaller channel diameters than in a case in which the first and second water jacket portions 31 and 33 are molded by one core. As a result, the flow rate of the cooling water in the first water jacket portions 31 becomes much higher.

The cooling water is supplied from the first water jacket portions 31 to the second water jacket portions 33 of this embodiment through the narrow channels 32. This makes the second water jacket portions 33 to have simpler structures than in a case in which the cooling water is supplied from outside the cylinder head 1 through a dedicated cooling water channel. As a result, the cylinder head 1 can be made compact.

According to this embodiment, the cooling water that has flowed from the first water jacket portion 31 into the narrow channel 32 of each cylinder flows into the second water jacket portion 33 of corresponding cylinder through the narrow channel 32. At this time, the position where the cooling water flows into the second water jacket portion 33 is at the portion that corresponds to the center of the crank shaft in the axial direction. Thus, the cooling water flowing into the second water jacket portion 33 does not flow only locally in the axial direction of the crank shaft, but also flows in the second water jacket portion 33 from a position closer to the center of each cylinder to the other side in the lateral direction. As a result, the cooling water flowing in the second water jacket portion 33 cools the portion above the exhaust port 3 and the periphery of the exhaust-valve valve stem guides 23 evenly and efficiently.

According to this embodiment, boring is performed in each narrow channel 32 by the drill to form the through hole 66 at that portion of the narrow channel 32 which corresponds to the boundary of the first core 34 and second core 35. This removes the casting burr formed in the narrow channel 32. Also, the narrow channel 32 is formed to have a highly accurate hole diameter. Therefore, in every cylinder, the flow rates of cooling water flowing through the narrow channels 32 into the second water jacket portions 33 become uniform, so that the temperature difference among cylinders can be decreased more.

According to this embodiment, each narrow channel 32 is located on the corresponding virtual line L which extends to the exhaust port 3 side through the center of the cylinder hole when seen from the axial direction of the cylinder. Hence, the through hole 66 can be formed in the narrow channel 32 by inserting the drill 65 from inside the spark plug inserting cylindrical wall 4 formed above the center of the cylinder hole. This facilitates boring to bypass the exhaust cam shaft supporting journal 24*a* formed outside the second water jacket portion 33.

According to this embodiment, as the first core 34 supports one end of the second core 35, no dedicated core print is necessary to support one end of the second core 35. Hence, according to this embodiment, the second water jacket portion 33 can be formed to have a necessary minimum volume.

According to this embodiment, the cooling water flowing in the first water jacket portions 31 of the respective cylinders is discharged from the first cooling water discharge channel 42 through the first cooling water discharge port 57. The cooling water flowing in the second water jacket portions 33 of the respective cylinders is discharged from the second cooling water discharge channel 71 through the second cooling water discharge port 70. Hence, according to this embodiment, when discharging the cooling water from the cylinder head 1, only the first cooling water discharge port 57 and second cooling water discharge port 70 need be formed. This makes the structure of the cylinder head 1 simpler than in a case in which such a discharge port is formed for each cylinder.

In addition, the first cooling water discharge channel 42 can be molded by the first core 34, and the communication channels 63 can be molded by the second core 35. Therefore, according to this embodiment, the channels 42 and 63 can be formed in the cylinder head 1. This makes the cylinder head 1 more compact than in a case in which such channels are formed outside the cylinder head 1.

According to this embodiment, the entire amount of the cooling water flowing in the first water jacket portions 31 flows through the central portions 40, that is, around the lower ends 4*a* of the spark plug inserting cylindrical walls 4. Hence, according to this embodiment, particularly high-temperature portions can be cooled reliably.

In this embodiment, to form the narrow channels 32, the projections 64 are provided to the second core 35. Alternatively, the projections 64 can be provided to the first core 34, or to both the first core 34 and second core 35.

(Second Embodiment)

In the first embodiment shown in FIGS. 1 to 8, casting is performed with the projections of the second core being placed on the support seats of the first core, and thereafter boring is performed. However, the present invention is not limited to this particular example. For example, a fitting structure as shown in FIG. 9 can make boring unnecessary.

Figure 9:
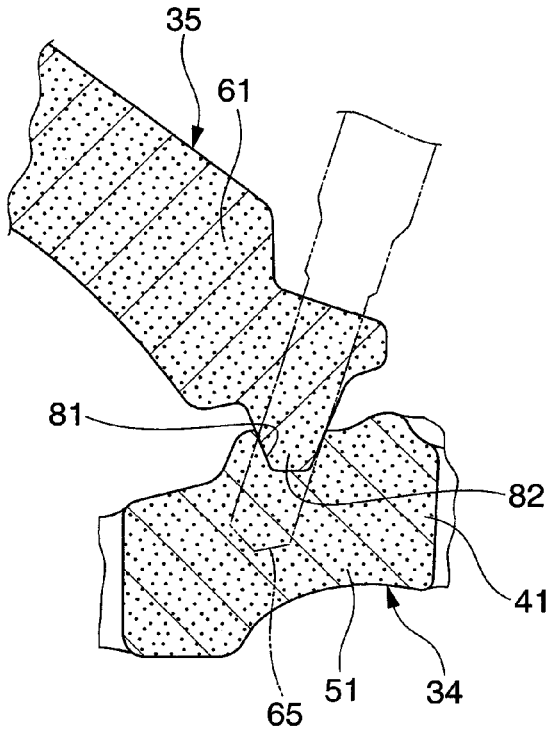
FIG. 9 is a sectional view sowing another example of the contact portion of the first core and second core.

FIG. 9 is a sectional view showing another example of the contact portion of the first core and second core. In FIG. 9, the same or equivalent members as those described with reference to FIGS. 1 to 8 are denoted by the same reference numerals, and a repetitive description thereof will be omitted when appropriate.

The contact portion of a first core 34 and second core 35 shown in FIG. 9 comprises a recess 81 formed in the first core 34 and a projection 82 of the second core 35 which is to fit in the recess 81.

The recess 81 is formed to open upward. The opening and cross section of the recess 81 are circular. The inner surface of the recess 81 is inclined such that the opening diameter gradually increases upward from the bottom of the recess 81.

The projection 82 is formed at one end of the second core 35 to project downward. The projection 82 has a frustoconical shape which projects downward to fit in the recess 81 from above. That end of the second core 35 where the projection 82 is formed is supported by the first core 34 through the projection 82.

During casting, the molten metal does not easily enter the fitting portion of the recess 81 and projection 82. If, in this manner, a fitting structure comprising the recess 81 and projection 82 brings the first core 34 and second core 35 into contact with each other, a narrow channel 32 can be formed without boring. In this embodiment, as the weight of one end of the second core 35 is applied to the fitting portion, entering of the molten metal into the fitting portion becomes more difficult. Even when this fitting structure is employed, if the molten metal enters the fitting portion, a burr may be undesirably formed in the narrow channel 32. To prevent this, a through hole may be formed in the narrow channel 32 by a drill 65 as indicated by an alternate long and two short dashed line in FIG. 9.

According to this embodiment, the projection 82 (one end) of the second core 35 is supported by the first core 34 while it is fitted in the recess 81. Accordingly, in the same manner as in the first embodiment, no core print that dedicatedly supports one end of the second core 35 is necessary. Hence, in the second embodiment as well, a second water jacket portion 33 can be formed to have a necessary minimum volume.

According to this embodiment, the recess 81 is formed in the first core 34, and the projection 82 is formed on the second core 35. Alternatively, the recess 81 can be formed in the first core 34, and the projection 82 can be formed on the first core 34.

(Third Embodiment)

Figure 10:
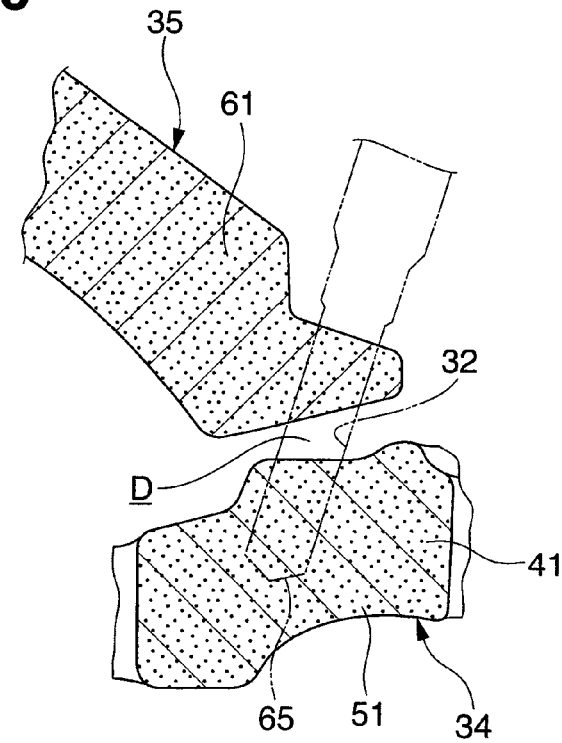
FIG. 10 is an enlarged sectional view of the main part of the first core and second core.

As shown in FIG. 10, one end of the second core can be mounted in a mold to be upwardly separate from the first core.

FIG. 10 is an enlarged sectional view of the main part of the first core and second core. In FIG. 10, the same or equivalent members as those described with reference to FIGS. 1 to 8 are denoted by the same reference numerals, and a repetitive description thereof will be omitted when appropriate.

On end of a second core 35 shown in FIG. 10 is mounted in a mold to be upwardly separate from a first core 34 at a predetermined gap through a space D. More specifically, the second core 35 of this embodiment is supported in the mold such that the weight of one end of it does not act on the first core 34. In this case, the first and second cores are removed after casting, and a narrow channel 32 is formed in a wall corresponding to the space of the cylinder head 1 by a drill 65 as indicated by an alternate long and two short dashed line in FIG. 10. In the same manner as in the first embodiment, the drill 65 is inserted in a first water jacket portion 31 from outside (the interior of a spark plug inserting cylindrical wall 4) of a second water jacket portion 33 through the interior of a second water jacket portion 33.

To support the second core 35 with the mold in a cantilever manner as shown in FIG. 10, the second core 35 is firmly supported by a plurality of columnar projections 68 that form core prints in FIG. 5. To implement this, desirably, longitudinal extending portions 62 of the second core 35 are formed to each have a thickness (width in the lateral direction) larger than that of each longitudinal extending portion 62 shown in FIG. 5 (to be wide in the lateral direction), thereby improving the rigidity of the other end of the second core 35.

When adopting this support structure, the positions of head-bolt bolt holes 6 of a cylinder head 1, oil return holes 9 near the bolt holes 6, and the like must be changed from the positions shown in FIG. 4, so that interference with the longitudinal extending portions 62 can be avoided.

To firmly support the second core 35 in the cantilever manner, the following arrangement can be employed. More specifically, a columnar projection 69 identical to that in FIG. 5 which is provided to one end of the second core 35 in the longitudinal direction is utilized as a core print as well. Also, a columnar projection (not shown) which forms a core print is formed at the other end of the second core 35 in the longitudinal direction. For example, when the present invention is to be applied to a 2-cylinder engine, the number of core prints is increased in this manner to support the two ends of the second core 35 in the longitudinal direction. With this arrangement, the longitudinal extending portions 62 are formed small as shown in FIG. 5, thereby maintaining the second water jacket portions 33 to have small volumes.

Hence, by adopting the arrangement as shown in FIG. 10 in which the narrow channel 32 is formed by the drill 65, the narrow channel 32 can be formed to have a highly accurate hole diameter. This allows cooling water flowing through the narrow channel 32 to have an even flow rate in every cylinder, so that the temperature difference among the cylinders can be further decreased. If the narrow channel 32 is located on a virtual line L (see FIG. 4) which extends toward the exhaust port through the center of a cylinder hole when seen from the axial direction of the cylinder, a through hole 66 can be formed in the narrow channel 32 by the drill 65. The drill 65 can be inserted inside the spark plug inserting cylindrical wall 4 which is formed above the center of the cylinder hole. In this case, this facilitates boring to avoid a cam shaft bearing (journal 24*a*) formed outside the second water jacket portion 33.

What is claimed is:

1. A multiple cylinder engine cooling apparatus comprising:

a bottom wall of a cylinder head in which a plurality of combustion chamber forming recesses are formed to line up in a longitudinal direction parallel to an axial direction of a crank shaft;

a lower end of a spark plug inserting cylindrical wall extending from each of said recesses upward in a direction opposite to said combustion chambers;

a lower end of an inlet port extending from each of said recesses laterally in one direction perpendicular to the longitudinal direction;

an exhaust port extending from each of said recesses laterally in the other direction; and a water jacket formed in said cylinder head to cool said bottom wall of said cylinder head, said lower end of said spark plug inserting cylindrical wall, said lower end of said inlet port, and said exhaust port, said water jacket comprising a first water jacket portion through which cooling water flows in the lateral direction from an exhaust port side toward an inlet port side for each cylinder, and a second water jacket portion which is connected to said first water jacket portion through a narrow channel and guides the cooling water from an interior of said first water jacket portion upward along said exhaust port, wherein said first water jacket portion and said second water jacket portion are respectively connected to cooling water discharge ports to discharge cooling water outside said cylinder head, said narrow channel is formed to have a smaller channel sectional area than that of said first water jacket portion or said second water jacket portion, said narrow channel is located on a virtual line extending toward said exhaust port through a center of a cylinder hole when seen from an axial direction of said cylinder, and said narrow channel is formed only at a position adjacent to said spark plug.

2. An apparatus according to claim 1, wherein said first water jacket portion is molded by a first core having a shape that covers said bottom wall of said cylinder head from above and surrounds said lower end of said cylindrical wall, said lower end of said inlet port, and a lower end of said exhaust port, said second water jacket portion is molded by a second core which is different from said first core and has a shape that covers said exhaust port from above, and said narrow channel is molded by a projection which is formed in at least one of said first core and said second core to come into contact with the other one of said first core and said second core.

3. An apparatus according to claim 2, wherein said projection is formed on at least one of said first core and said second core and fitted in a recess formed in said other one of said first core and said second core.

4. An apparatus according to claim 2, wherein one end of said second core is supported by said first core at a contact portion with said first core.

5. An apparatus according to claim 2, wherein a through hole is formed at a portion of said narrow channel which corresponds to a contact portion of said first core and said second core, and said through hole is formed, after said first core and said second core are removed after casting, by a drill which is inserted from outside said second water jacket portion into said first water jacket portion through an interior of said second water jacket portion.

6. An apparatus according to claim 1, wherein said first water jacket portion is molded by a first core having a shape that covers said bottom wall of said cylinder head from above and surrounds said lower end of said cylindrical wall, said lower end of said inlet port, and a lower end of said exhaust port, said second water jacket portion is molded by a second core which is different from said first core and has a shape that covers said exhaust port from above and opposes a portion above said first core with one end thereof through a space, and said narrow channel is formed, after said first core and said second core are removed after casting, in a wall of said cylinder head which corresponds to said space, said narrow channel being formed by inserting a drill from outside said second water jacket portion into said first water jacket portion through an interior of said second water jacket portion.

7. An apparatus according to claim 1, wherein a cooling water inlet of said first water jacket portion is open to in a lower end of said cylinder head on a side which is close to said exhaust port, a cooling water outlet of said first water jacket portion is open to in a first cooling water discharge channel which is formed to extend in the longitudinal direction below said inlet port, downstream ends of two adjacent second water jacket portions communicate with each other through a communication channel, and said downstream ends and said communication channel constitute a second cooling water discharge channel through which the cooling water flows in the longitudinal direction to be discharged.

8. An apparatus according to claim 1, wherein said first water jacket portion comprises an upstream portion surrounding a lower end of said exhaust port, a downstream portion surrounding said lower end of said inlet port, and a central portion surrounding a lower end of said spark plug inserting cylindrical wall, and said central portion is interposed between said upstream portion and said downstream portion.

* * * * *